US008475069B2

(12) United States Patent
Takahashi

(10) Patent No.: US 8,475,069 B2
(45) Date of Patent: Jul. 2, 2013

(54) PRINTER UNIT

(75) Inventor: Toshihiro Takahashi, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 1211 days.

(21) Appl. No.: 11/904,571

(22) Filed: Sep. 27, 2007

(65) Prior Publication Data

US 2008/0101842 A1 May 1, 2008

(30) Foreign Application Priority Data

Oct. 26, 2006 (JP) ..... 2006-291026

(51) Int. Cl.
*B41J 13/03* (2006.01)

(52) U.S. Cl.
USPC ..... 400/641; 400/629; 271/113; 492/42

(58) Field of Classification Search
USPC ..... 400/629
See application file for complete search history.

(56) References Cited

U.S. PATENT DOCUMENTS

| | | | | |
|---|---|---|---|---|
| 2,844,370 | A | 7/1958 | Thomas | |
| 3,630,516 | A | 12/1971 | Hong | |
| 4,664,252 | A * | 5/1987 | Galbraith | 198/722 |
| 4,943,182 | A * | 7/1990 | Hoblingre | 403/349 |
| 5,040,779 | A * | 8/1991 | Ogiri et al. | 271/109 |
| 5,156,388 | A * | 10/1992 | Morita | 271/109 |
| 5,501,542 | A * | 3/1996 | Hall, Sr. | 403/306 |
| 6,438,841 | B1 * | 8/2002 | Fuma et al. | 29/895.32 |
| 7,380,782 | B2 * | 6/2008 | Lien | 271/109 |
| 7,731,174 | B2 * | 6/2010 | Lee et al. | 271/109 |
| 2006/0180985 | A1 | 8/2006 | Lee et al. | |

FOREIGN PATENT DOCUMENTS

| | | |
|---|---|---|
| JP | 02-018435 | 2/1990 |
| JP | 02-018436 | 2/1990 |
| JP | 11-334904 | 12/1992 |
| JP | 06-144606 | 5/1994 |
| JP | 10-025033 | 1/1998 |
| JP | 2001294335 | 10/2001 |
| JP | 2004-256287 | 9/2004 |
| JP | 2005-320132 | 11/2005 |

OTHER PUBLICATIONS

Original and English translation of Chinese Office Action; Mar. 25, 2011; issued in counterpart Chinese Application No. 200710167025.0.

* cited by examiner

*Primary Examiner* — Jill Culler
(74) *Attorney, Agent, or Firm* — McCarter & English, LLP

(57) ABSTRACT

In a portable small size printer unit 1, when a pickup roller is replaced, user grips a roller main body and slides it resisting a bias force of a spring. Consequently, when the roller main body is slid, the entire length of the pickup roller is shortened, so that a first convex portion is removed from a first concave portion. After that, the front end of a slide shaft member is removed from a shaft mounting portion by tilting the roller main body and then, the pickup roller is removed from the printing mechanism unit. By sliding the slide shaft member outward of the roller main body, the roller main body is taken out of the slide shaft member and the like so as to replace only the roller main body.

2 Claims, 10 Drawing Sheets

PRINTER UNIT

CROSS-REFERENCE TO RELATED APPLICATIONS

The present application claims priority from JP 2006-291026, filed on Oct. 26, 2006, the disclosure of which is herein incorporated by reference in its entirety.

TECHNICAL FIELD

The disclosure relates to a printer unit which executes a predetermined printing activity by supplying printing object mediums with a supplying means, the printing object mediums being accommodated in an accommodating portion such that they are stacked, and more particularly to a printer unit having a supply roller which rotates in contact with the printing object mediums stacked in the accommodating portion based on driving of a supply driving means.

BACKGROUND

Conventionally, there has been known a printer unit in which the printing object mediums are accommodated in a laminated manner in the accommodating portion thereof in order to supply the printing object medium to the printing means by rotating the supply roller kept in contact with the printing object medium. When printing is executed, the supply roller is rotated to supply the recording object medium. Thus, if the printer unit continues to be used, such a fault as paper feeding trouble is generated because the supply roller is deteriorated. To eliminate such a fault, the supply roller needs to be replaced, however a conventional printer unit takes much time and labor for the replacement work of the supply roller because the supply roller is incorporated within the printer unit main body.

As a disclosure for solving this kind of the problem, an invention described in Japanese Patent Application Laid-Open No. 2001-294335 has been well known. The Japanese Patent Application Laid-Open No. 2001-294335 has described an invention relating to an image forming apparatus in which a supply unit including the supply roller is attached detachably. That is, the image forming apparatus described in the Japanese Patent Application Laid-Open No. 2001-294335 enables the supply unit to be replaced when the supply roller is deteriorated and needs to be replaced. Consequently, related consumption components can be replaced without disassembling the image forming apparatus entirely.

However, even when a consumption component (for example, a supply roller) is deteriorated in the image forming apparatus described in the Japanese Patent Application Laid-Open No. 2001-294335, the entire supply unit needs to be replaced. That is, in case of the image forming apparatus described in the Japanese Patent Application Laid-Open No. 2001-294335, even if a separation feeding roller or the like constituting the supply unit is still usable, the entire supply unit is replaced, which is a large waste. Additionally, because the entire supply unit is replaced, the cost relating to the replacement component becomes higher than a case of replacing only the supply roller.

When replacing the supply roller in the image forming apparatus described in the Japanese Patent Application Laid-Open No. 2001-294335, disassembly work of the supply unit and reassembly work of the supply unit after the supply roller is replaced are necessary because the supply roller is assembled into the supply unit. In this case, other components than the supply roller of the supply unit need to be disassembled, resulting in that extremely much time and labor are required for the replacement work of the supply roller. In this point, because the supply unit itself is constructed in a relatively complicated structure, time and labor required for the replacement work of the supply roller increase. Further, because the supply unit needs to be reassembled after the supply roller is replaced, if the assembly work is not carried out accurately, the image forming apparatus may not operate properly. Particularly, because other components than the supply roller are disassembled upon replacement work, a fault (a fault caused by the replacement work is called a secondary fault) may occur in any component which operates properly before the replacement.

SUMMARY

Accordingly, the disclosure has been achieved to solve the above-described conventional problems and an object of the disclosure is to provide a printer unit which executes a predetermined printing activity by supplying printing object mediums with a supplying means, the printing object mediums being accommodated in an accommodating portion such that they are stacked, and more particularly, a printer unit which allows the supply roller which rotates in contact with the printing object mediums stacked in the accommodating portion based on driving of the supply driving means to be replaced easily.

To achieve the purpose of the disclosure, there is provided a printer unit comprising: an accommodating portion which accommodates printing object mediums such that they are stacked; a printing means for printing the printing object medium based on a desired print data; a supply roller supported rotatably in contact with the printing object mediums accommodated in the accommodating portion; and a supply means having a supply drive means for rotating the supply roller for supplying the printing object medium to the printing means, wherein the supply roller includes: a drive shaft member which is rotated with driving of the supply drive means; roller member which has a contact portion making contact with the printing object medium on a peripheral face thereof while an end thereof is attached detachably to the drive shaft member and contains a sliding hole made at the other end along a center axis thereof; and a mounting shaft member which is inserted slidably into a sliding hole formed in the roller member so as to support the roller member rotatably, the mounting shaft member being rotated together with the roller member.

In this printer unit, the supply roller is comprised of the drive shaft member, the roller member and the mounting shaft member. When the drive shaft member is rotated by the supply driving means, the roller member is rotated interlocked therewith because it is attached detachably to the drive shaft member. Then, the mounting shaft member is rotated together with the roller member. That is, because components of the supply roller are rotated integrally in this printer unit, the printing object medium can be supplied to the printing means. In the supply roller of the printer unit, an end of the roller member is attached detachably to the drive shaft member while the mounting shaft member is inserted slidably into a sliding hole at the other end of the roller shaft member. Thus, by sliding the mounting shaft member, the supply roller itself can be shortened. Consequently, space which allows an end of the roller member to be removed from the drive shaft member can be created, so that the supply roller can be taken out of the printer unit main body. Further, the mounting shaft member can be removed from the roller member by sliding it. That is, because only the roller member can be separated easily, only the roller member which is a consumption part can be replaced easily and rapidly.

DETAILED DESCRIPTION

First Embodiment

Figure 1:
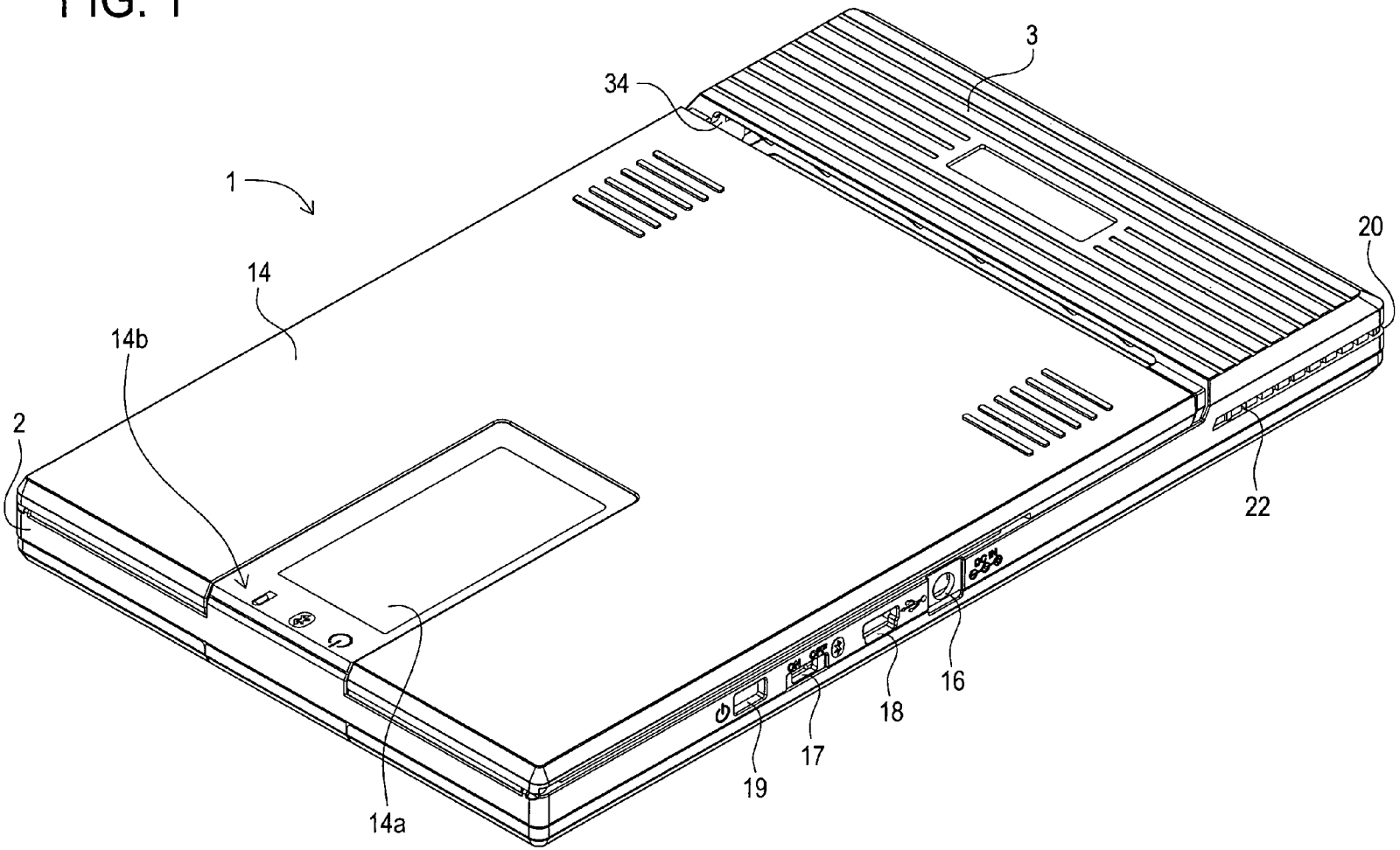
FIG. 1 is a perspective view of a portable small size printer unit.

Hereinafter, the printer unit of the disclosure will be described about an exemplary embodiment of the disclosure realized as a portable small size printer unit 1 with reference to the accompanying drawings. FIG. 1 is a perspective view of the portable small size printer unit 1.

The portable small size printer unit 1 has a box-type main body case 2 with an open top face having a size of A6 in its plan view and thickness of about 2 cm and a fixed cover body 3 is disposed on one side of the top face. A paper accommodating portion 6 for accommodating a paper cassette (not shown) in which a plurality of sheets of paper 4 are stacked is formed within the main body case 2 excluding this fixed cover body 3 (see FIGS. 2, 3). Here, the sheets of paper 4 are printing object mediums constituted of cut-sheet heat sensitive paper. In the meantime, as the paper 4, it is permissible to use heat sensitive coloring type having a coloring layer which is colored when heated, heat sensitive perforation type in which perforation layer to be perforated by heating is overlaid on a base material layer thereof and the like.

A printing mechanism unit 7 is disposed below the fixed cover body 3 of the main body case 2. This printing mechanism unit 7 includes a thermal head 8, a platen roller 9, a paper guide 10, a pickup roller 5, a separation block 12 and the like (see FIG. 3). The paper accommodating portion 6 is covered with a lid body 14 (see FIG. 1). This lid body 14 is supported on a side portion of the main body case 2 such that it can be opened/closed through an opening/closing supporting means which can rotate and slide. A transparent plastic window portion 14*a* is formed on the side of a rotating shaft of this lid body 14. This window portion 14*a* is provided with a status notifying portion 14*b* which indicates an operating condition of the portable small size printer unit 1 (for example, power supply ON/OFF, charging state of rechargeable battery, communication state and the like) according to light emission state. On the top face of the main body case 2, an LED light emission portion 15 is formed on the side of the rotating shaft of the lid body 14 (see FIG. 2). This LED light emission portion 15 is formed of transparent plastic so that light from an LED (not shown) disposed within the main body case 2 is transmitted through and the LED is lit according to a predetermined lighting style corresponding to the operating condition of the portable small size printer unit 1. Here, because the aforementioned status notifying portion 14*b* is located just above the LED emission portion 15 when the lid body 14 is closed, if the lighting style of the LED disposed below the LED light emission portion 15 is changed, the lighting style of the status notifying portion 14*b* is also changed. That is, a user can grasp the operating condition of the portable small size printer unit 1 by recognizing the lighting style of the status notifying portion 14*b*.

A charging connector 16, a communication switch 17, a USB terminal 18, and a power key 19 are disposed on the side face of the main body case 2. When the rechargeable battery which is a driving source for the portable small size printer unit 1 by receiving a supply of power from an external power supply (not shown), an AC adapter (not shown) is connected to the charging connector 16. The communication switch 17 is a switch which switches on/off transmission/receiving of data transmitted via electromagnetic wave from a portable terminal having wireless communication unit such as portable phone and PDA. The USB terminal 18 is constructed to be capable of being connected to a portable terminal or personal computer through a USB cable (not shown) and receives data transmitted via the USB cable. The power key 19 is an operating means for turning power ON/OFF to the portable small size printer unit 1.

A mounting groove 20 is formed in U shape on the side face on the fixed cover body 3 side of the main body case 2. A supporting base (not shown) for use in supporting the portable small size printer unit 1 in a standing condition is mounted on this mounting groove 20. Then, the mounting groove 20 contains a plurality of air holes 22. Because the air holes 22 communicate with outside of the main body case 2, the thermal head 8 and the driving motor 21 disposed on the printing mechanism unit 7 can be cooled. Additionally, a hooking hole (not shown) is formed in the mounting groove 20 and this hooking hole enables a strap or an anti-theft wire (not shown) to be attached.

Figure 3:
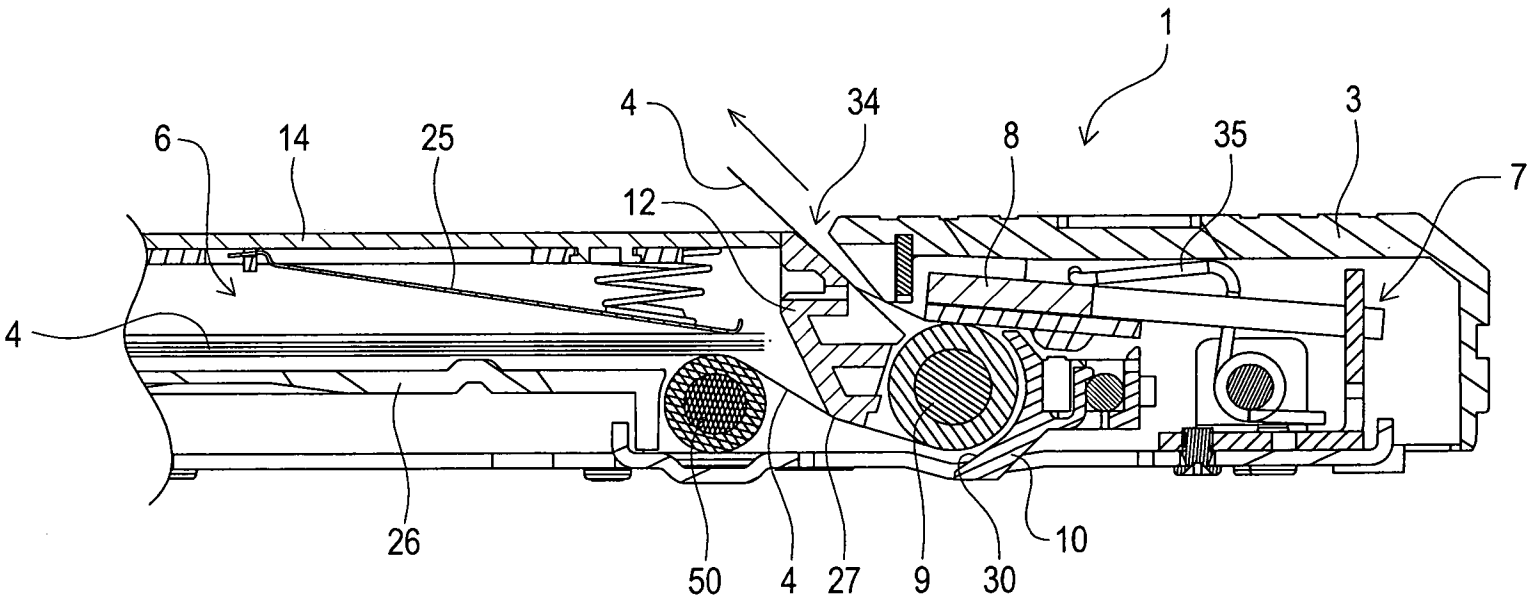
FIG. 3 is a sectional side view of the vicinity of a printing mechanism unit of the portable small size printer unit.

Next, the structure of the printing mechanism unit 7 of the portable small size printer unit 1 of the first embodiment will be described in detail with reference to the drawings. FIG. 3 is an explanatory diagram showing the internal structure of the printing mechanism unit 7 of the portable small size printer unit 1.

As described above, the printing mechanism unit 7 is disposed below the fixed cover body 3 of the main body case 2. Within the printing mechanism unit 7, a pickup roller 50 for supplying the paper accommodating portion 6 to the thermal head 8 and the like and a separation block 12 for separating each of the sheets of paper 4 supplied by the pickup roller 50 are disposed on the side of the paper accommodating portion 6 of the portable small size printer unit 1 (see FIGS. 2, 3).

As shown in FIG. 3, a paper pressing member 25 is disposed on the side face within the lid body 14. This paper pressing member 25 is composed of a leaf spring or the like, biasing the papers 4 accommodated in the paper accommodating portion 6 downward (direction to a bottom plate 26 of the paper accommodating portion 6). Therefore, when the papers 4 are accommodated in the paper accommodating portion 6 and the lid body 14 is closed, the paper 4 located on the bottommost of the stacked papers 4 makes contact with and is biased by the top face of a pickup roller 50 by the paper pressing member 25.

Figure 4:
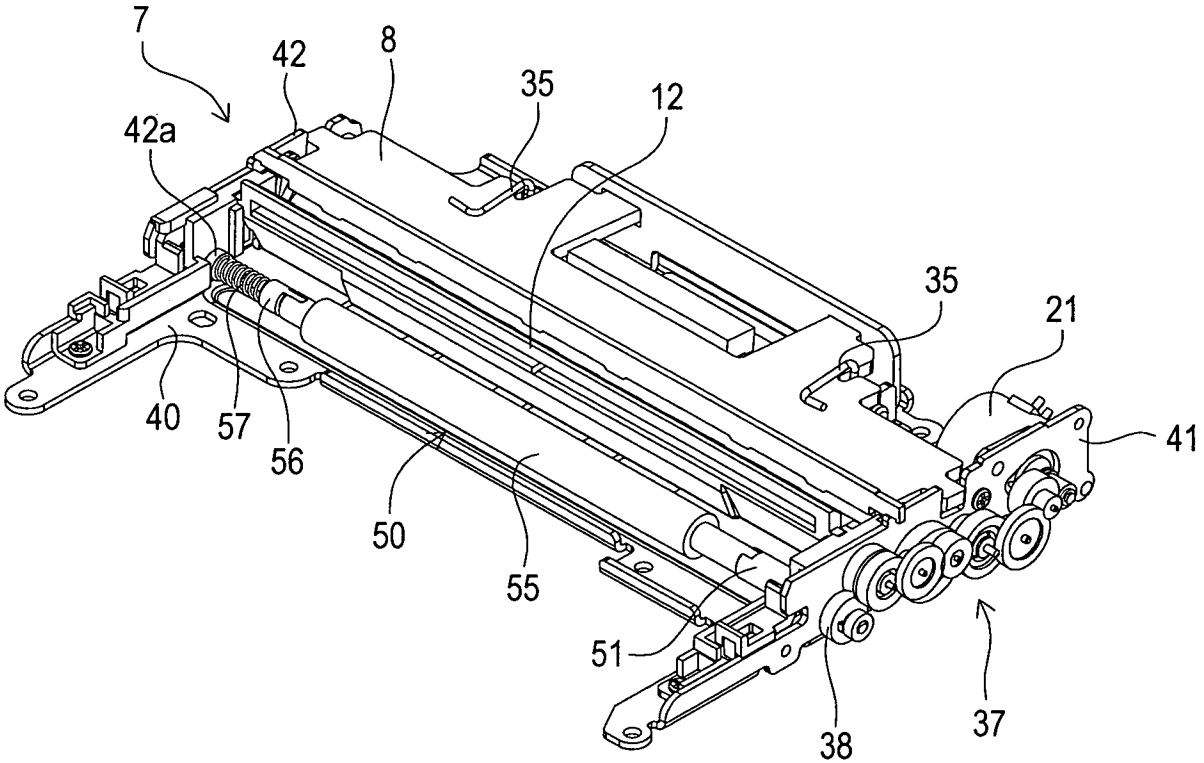
FIG. 4 is a perspective view of the printing mechanism unit.

When a print instruction or print data is sent from an external unit such as a portable phone to the portable small size printer unit 1 through wireless communication or USB terminal 18, driving of the driving motor 21 (see FIG. 4) is started. As shown in FIG. 4, this driving motor 21 transmits a driving force to the pickup roller 50 through a train of gears. Thus, when the driving motor 21 is driven, the rotation of the pickup roller 50 is started. Consequently, the paper 4 in contact with and biased by the top face of the pickup roller 50 is fed to the separation block 12. Then, when the front end of the fed paper 4 comes into contact with a guide engaging face 27 of the separation block 12, only the paper 4 on the bottommost layer is fed separately through a gap formed at the bottom end of the separation block 12 by cooperation of the pickup roller 50 and the guide engaging face 27.

The paper 4 fed separately by cooperation of the pickup roller 50 and the separation block 12 is fed to a gap between the platen roller 9 and the paper guide 10. The platen roller 9 is provided rotatably at a position adjacent to the separation block 12. Because driving force of the driving motor is transmitted through a gear string 37 like the aforementioned pickup roller 50, the platen roller 9 is rotated interlocked with the driving of the driving motor 21. The paper guide 10 is a member for guiding the fed paper 4 to a print position described later along the outer peripheral face of the platen roller 9. The paper guide 10 is disposed along the platen roller 9 so as to form a sliding contact face 30. Here, the sliding contact face 30 has a substantially U-shaped section formed in the paper guide 10 and located along the outer peripheral face of the platen roller (see FIG. 3). That is, the paper 4 fed in between the platen roller 9 and the paper guide 10 is inverted into a U shape as seen in its side view and fed along the sliding contact face 30 of the paper guide 10 with a rotation of the pickup roller 50 and the platen roller 9. Consequently, the paper 4 is fed up to a print position where the thermal head 8 makes contact with the paper on the top face of the platen roller 9.

After the paper 4 is fed to the print position, printing is performed on the paper 4 based on inputted print data by the thermal head 8 and platen roller 9. The thermal head 8 is a line head type thermal head, which can print characters, pictures and the like on every line extending in a direction perpendicular to the feeding direction of the paper 4. In the thermal head 8, a print width for printing a single line is set substantially equal to the width of the paper 4. The reason for use of the thermal head 8 as the print head is that using the heat sensitive paper as the printing object paper eliminates the necessity of consumption products such as ink and ink ribbon thereby omitting related mechanisms so as to form the portable small size printer unit 1 in a compact size.

As shown in FIG. 3, a spring hook portion for a coil spring 35 is attached to the rear face (top face side) of the thermal head 8. Consequently, the thermal head 8 is biased against the platen roller 9 so that the print portion of the thermal head 8 comes into contact with the top face of the platen roller 9. Thus, the paper 4 fed up to the print position is sandwiched by the outer peripheral face of the platen roller 9 and the print portion of the thermal head 8 when being fed. By controlling conduction condition to the print portion of the thermal head 8 based on print data at this time, printing is performed on the paper 4 based on the inputted print data. After that, the paper 4 printed by the thermal head 8 is discharged out of the main body case 2 through a discharge port 34 formed in a gap between the top face of the separation block 12 and the edge of the fixed cover body 3 with a rotation of the platen roller 9 and the pickup roller 50.

The structure of the pickup roller 50 disposed on the printing mechanism unit 7 of the portable small size printer unit 1 will be described in detail with reference to the drawings. As shown in FIG. 4, the printing mechanism unit 7 is constructed by disposing the thermal head 8, the paper guide 10, the separation block 12, the pickup roller 50 and the like on the frame 40. The frame 40 is constructed of a first side face 41 and a second side face 42, which are apart from each other at a substantially equal distance to the width of the portable small size printer unit 1. The driving motor 21 and the gear string 37 are disposed on the first side face (see FIG. 4). Further, a drive shaft member 51 which constitutes the pickup roller 50 is disposed on the first side face 41 such that it penetrates the first side face 41. The front end of the drive shaft member 51 is attached to the roller drive gear 38 which constitutes the gear string 37 such that it penetrates the first side face 41. When the gear string 37 is rotated with a driving of the driving motor 21, the roller drive gear 38 is rotated, so that the drive shaft member 51 is rotated. Consequently, the pickup roller 50 itself is rotated.

On the other hand, a shaft mounting portion 42*a* is formed at a position opposing the arrangement position of the drive shaft member 51 on the first side face 41. The shaft mounting portion 42*a* is formed into a cylindrical shape having an inside diameter slightly larger than the outside diameter of the front end of a slide shaft member 58 described later on the inside face of the second side face 42. Then, the front end of the slide shaft member 58 is fitted to the shaft mounting portion 42*a*. Because the inside diameter of the shaft mounting portion 42*a* is set slightly larger than the outside diameter of the front end of the slide shaft member 58, a rotation of the slide shaft member 58 is never obstructed when the front end of the slide shaft member 58 is fitted to the shaft mounting portion 42*a*.

Figure 5:
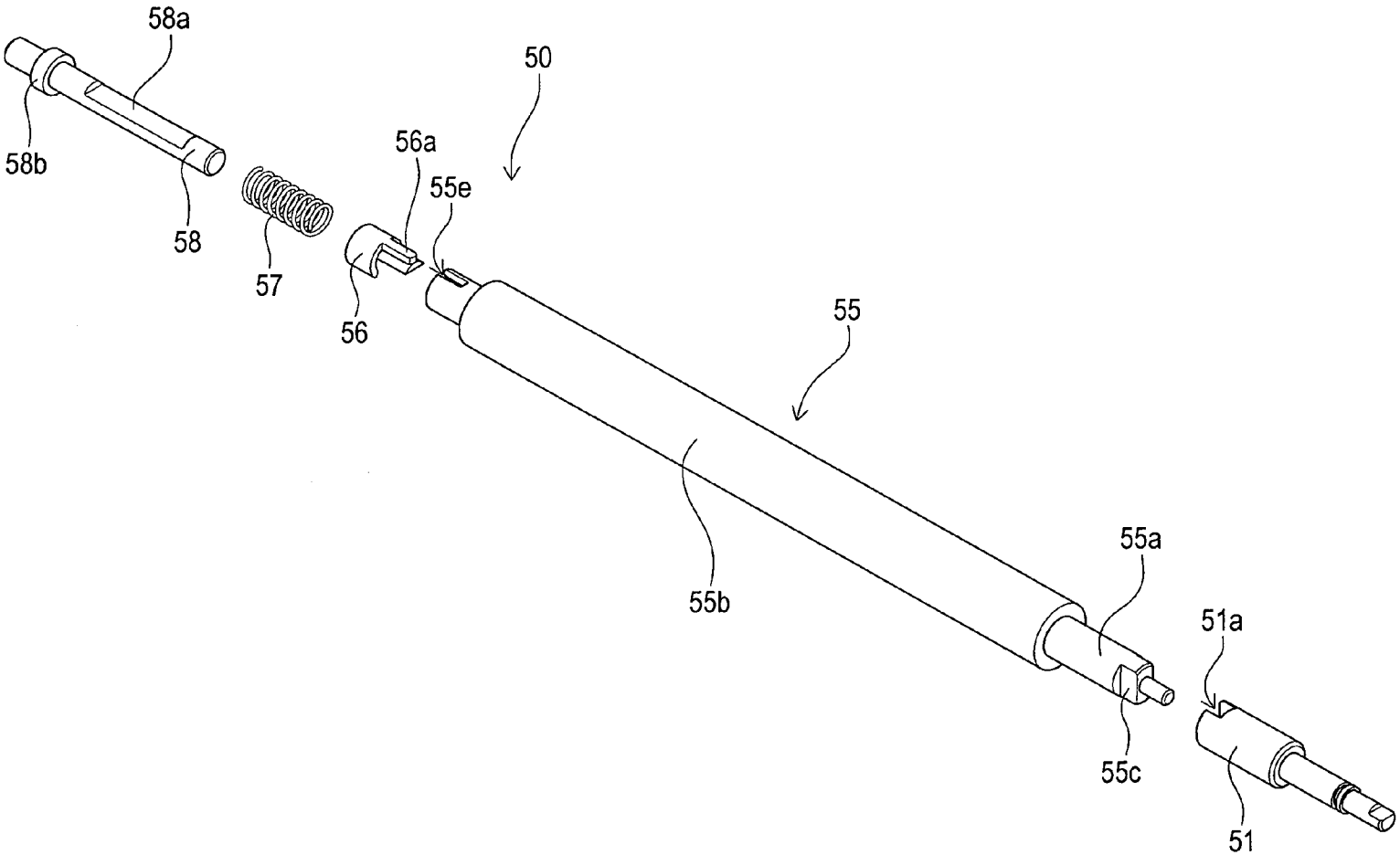
FIG. 5 is an explanatory diagram showing the structure of a pickup roller according to a first embodiment.

Next, the structure of the pickup roller 50 disposed in the portable small size printer unit 1 of the first embodiment will be described in detail with reference to the drawings. As shown in FIG. 5, the pickup roller 50 of the first embodiment is comprised of the drive shaft member 51, a roller main body 55, a rotation restricting member 56, a spring 57 and a slide shaft member 58. As described above, the drive shaft member 51 is mounted on the roller drive gear 38 of the gear string 37 disposed on the outside face of the first side face 41 such that it penetrates the first side face of printing mechanism unit 7. Thus, when the roller drive gear 38 constituting the gear string 37 is rotated by the driving of the driving motor 21, the drive shaft member 51 is rotated. In the meantime, this drive shaft member 51 cannot be removed from the first side face 41 because it is mounted on the roller drive gear 38 such that it penetrates the first side face 41. The drive shaft member 51 has a first concave portion 51*a* at an end portion on an opposite side to the end portion provided with the roller drive gear 38. A first convex portion 55*c* formed at an end of the roller main body 55 described later is fitted to this first concave portion 51*a* (see FIGS. 5, 6). A rotation force generated in the drive shaft member 51 is transmitted to the roller main body 55 securely because the first convex portion 55*c* is fitted to the first concave portion 51*a*.

The roller main body 55 is comprised of a roller shaft member 55*a* formed cylindrically and coating rubber 55*b* disposed on the outer peripheral face of the roller shaft member 55*a* so as to come into contact with the paper 4. The first convex portion 55*c* to be fitted to the first concave portion 51*a* formed in the drive shaft member 51 is formed at an end of the roller shaft member 55*a* (see FIGS. 5, 6). The first convex portion 55*c* is so constructed that when it is fitted to the first concave portion 51*a*, it aligns the center axis of the drive shaft member 51 with the center axis of the roller main body 55 and a rotation force generated in the drive shaft member 51 is transmitted to the roller main body 55 securely. On the other hand, a sliding insertion hole 55*d* is formed at the other end of the roller shaft member 55*a* along the center axis of the roller shaft member 55*a* (see FIG. 6). A slide shaft member 58 is inserted slidably into this sliding insertion hole 55*d*. A cutout portion 55*e* is formed on an opening edge of the sliding insertion hole 55*d* by cutting out part of the opening edge. A restricting convex portion 56*a* of the rotation restricting member 56 described later is fitted into this cutout portion 55*e*.

An end side of the slide shaft member 58 is inserted slidably into the sliding insertion hole 55*d* in the roller main body 55 while the other end side thereof is fitted to the shaft mounting portion 42*a* in the second side face 42. As shown in FIG. 5, a sliding restricting portion 58*a* is formed in the vicinity of one end (side of the end portion which is to be inserted into the sliding insertion hole 55*d*) of the slide shaft member 58. This sliding restricting portion 58*a* is formed by cutting out a part of the peripheral face of the slide shaft member 58 into a flat face and the rotation restricting member 56 described later is installed thereto (see FIGS. 6, 7). On the other hand, a spring holding portion 58*b* having a diameter slightly larger than the diameter of the slide shaft member 58 is formed at the other end side (side of the end portion to be fitted to the shaft mounting portion 42*a*) of the slide shaft member 58. An end of the spring 57 to be mounted around the slide shaft member 58 makes contact with this spring holding portion 58*b*.

The rotation restricting member 56 is a member for restricting a rotation of the slide shaft member 58 relative to the roller main body 55. The rotation restricting member 56 is provided to restrict itself from rotating relative to the slide shaft member 58 on the sliding restricting portion 58*a* of the slide shaft member 58. The rotation restricting member 56 has a flat face which makes contact with the flat face formed in the sliding restricting portion 58*a* and the rotation restricting member 56 is mounted not to rotate relative to the slide shaft member 58 by cooperation of the both flat faces. In the meantime, the rotation restricting member 56 can slide in the axial direction of the slide shaft member 58 on the sliding restricting portion 58*a*. A restricting convex portion 56*a* is formed on the rotation restricting member 56. As described above, this restricting convex portion 56*a* is fitted to the cutout portion 55*e* formed in the roller main body 55 (see FIGS. 2, 6). Thus, when the restricting convex portion 56*a* is fitted to the cutout portion 55*e*, a rotation driving force generated in the roller main body 55 is transmitted to the rotation restricting member 56. Because the rotation restricting member 56 is provided to rotate with the slide shaft member 58, the rotation force generated in the roller main body 55 is transmitted to the slide shaft member 58 through the rotation restricting member 56. That is, a rotation force generated in the drive shaft member 51 when the driving motor 21 is driven is transmitted to the roller main body 55 and the slide shaft member 58, entirely the pickup roller 50 can be rotated by the driving of the driving motor 21.

The spring 57 is a coil spring which is mounted around the slide shaft member 58 such that it is disposed between the spring holding portion 58*b* and the rotation restricting member 56. An end of the spring 57 makes contact with the rotation restricting member 56 while the other end of the spring 57 makes contact with the spring holding portion 58*b*. Therefore, bias force of the spring 57 acts in a direction of sliding the slide shaft member 58 outward. Consequently, when the pickup roller 50 is mounted, the spring 57 acts to extend the pickup roller 50 by its bias force, thereby preventing the front end of the slide shaft member 58 from slipping out of the shaft mounting portion 42*a* at the time of normal use.

Figure 6A:
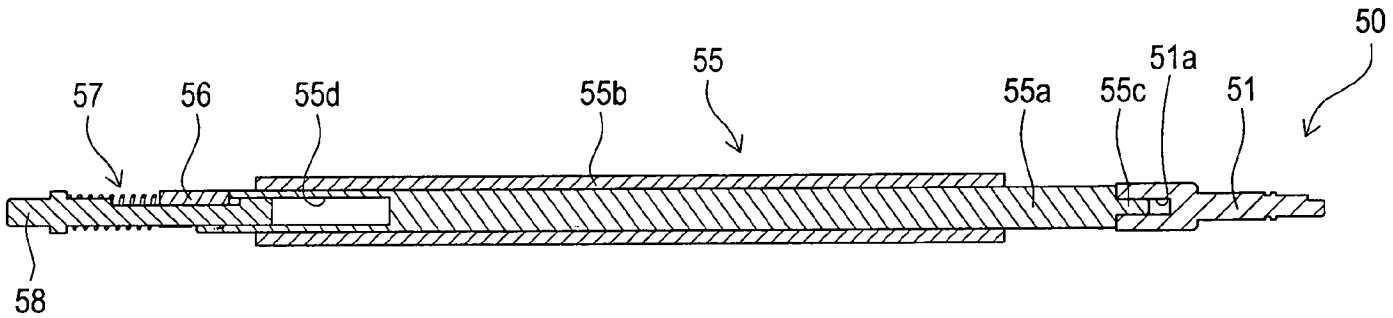
FIG. 6A is a sectional side view showing a condition in which a pickup roller of the first embodiment is mounted to the printing mechanism unit.
Figure 6B:
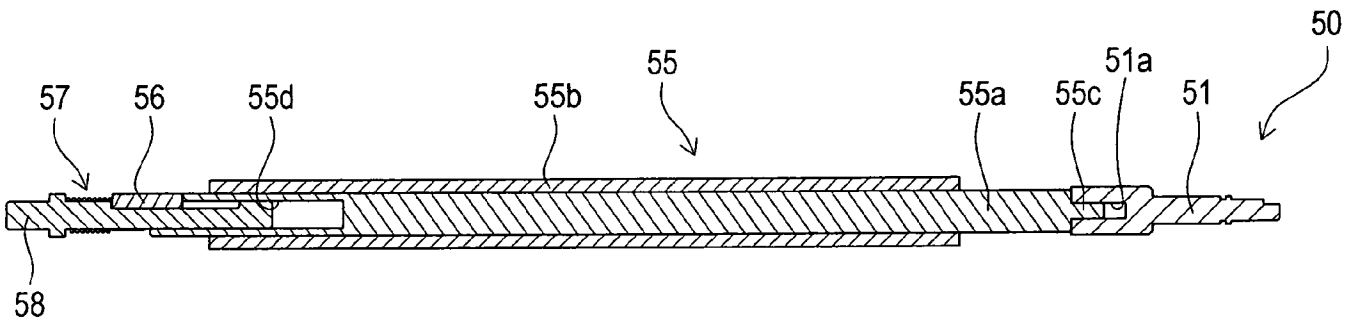
FIG. 6B is a sectional side view showing a condition in which the slide shaft member of the pickup roller of the first embodiment is slid resisting bias force of a spring.
Figure 7A:
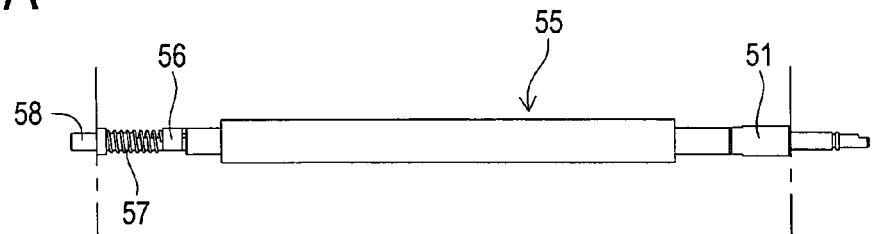
FIG. 7A is a diagram showing normal condition of the pickup roller of the first embodiment.
Figure 7B:
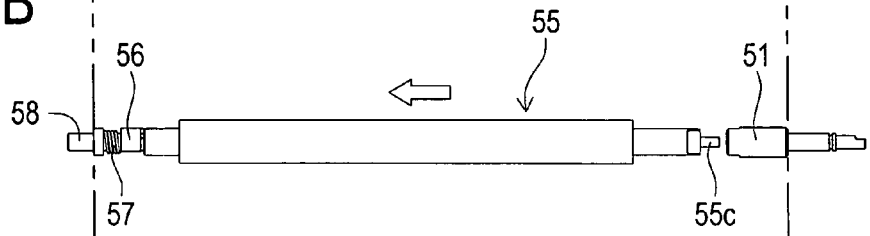
FIG. 7B is a diagram showing a condition in which the pickup roller of the first embodiment is slid.
Figure 7C:
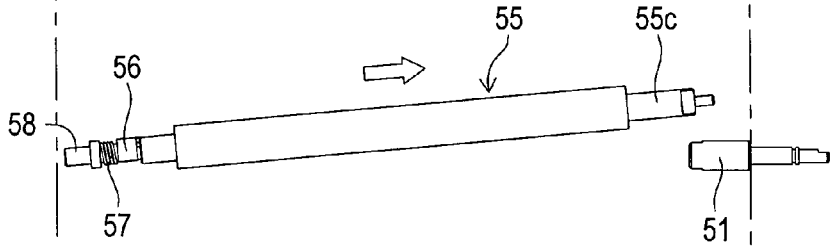
FIG. 7C is a diagram showing a condition in which the pickup roller of the first embodiment is removed from a shaft driving member.
Figure 7D:
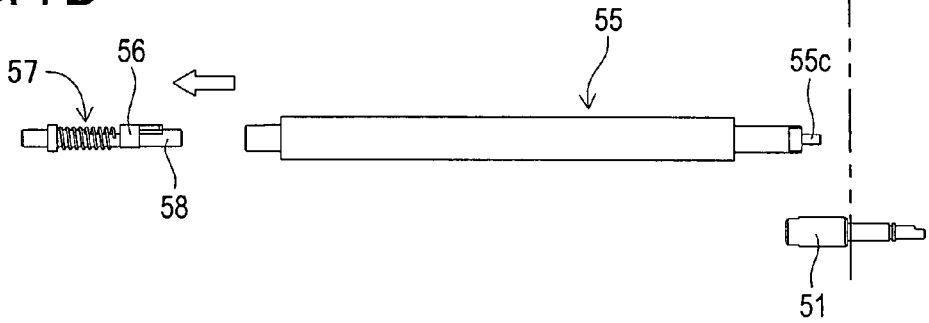
FIG. 7D is a diagram showing a condition in which the rotation restricting member, spring and slide shaft member of the pickup roller of the first embodiment are removed.

When the slide shaft member 58 is slid resisting the bias force of the spring 57 from the normal condition shown in FIG. 6A (condition in which the pickup roller 50 is mounted on the printing mechanism unit 7), the slide shaft member 58 is inserted deeper into the sliding insertion hole 55*d* of the roller main body 55 (see FIG. 6B). Thus, the length of the entire pickup roller 50 can be shortened. At this point, the rotation restricting member 56 disposed on the slide shaft member 58 never obstructs sliding motion of the slide shaft member 58, that is, elongation/contraction of the pickup roller 50 because it is disposed slidably within the sliding restricting member 58*a*.

Next, a procedure for replacement work of the pickup roller 50 in the portable small size printer unit 1 of the first embodiment will be described in detail with reference to the drawings. FIGS. 7A-7D are explanatory diagrams showing the procedure of the replacement work of the pickup roller 50. When the coating rubber 55*b* of the pickup roller 50 is so deteriorated that it needs to be replaced, a replacement worker grips the roller main body 55 of the pickup roller 50 mounted on the printing mechanism unit 7 and moves it toward the shaft mounting portion 42*a*. Consequently, the roller main body 55 is slid in the axial direction of the pickup roller 50 resisting the bias force of the spring 57, whereby the pickup roller 50 is contracted in its entire length (see FIG. 7B) as compared with the normal condition (see FIG. 7A). When the pickup roller 50 is shortened, the first convex portion 55*c* of the roller main body is removed from the first concave portion 51*a* of the drive shaft member 51.

After the roller main body 55 is removed from the drive shaft member 51, the replacement worker removes the front end of the slide shaft member 58 from the shaft mounting portion 42*a* (see FIG. 7C) by tilting the roller main body 55. At this time, the pickup roller 50 (roller main body 55, rotation restricting member 56, spring 57, slide shaft member 58) is removed from the printing mechanism unit 7 and can be taken out of the portable small size printer unit 1. After that, the replacement worker removes the rotation restricting member 56, the spring 57 and the slide shaft member 58 from the roller main body 55 by sliding the slide shaft member 58 outward of the roller main body 55 (see FIG. 7D). Because the spring 57 is mounted around the slide shaft member 58 and the rotation restricting member 56 is mounted to the sliding restricting portion 58*a* of the slide shaft member 58, the rotation restricting member 56, the spring 57, and the slide shaft member 58 can be removed from the roller main body 55 only by removing the slide shaft member 58 by sliding.

After the deteriorated roller main body 55 is replaced, the replacement worker mounts the previously removed rotation restricting member 56, spring 57 and slide shaft member 58 to a new roller main body 55. Because the respective members used before replacement can be used as the rotation restricting member 56, spring 57 and slide shaft member 58, the quantity of members replaced in the replacement work can be minimized. After that, the roller main body 55 is pressed toward the second side face 42 by fitting the front end of the slide shaft member 58 into the shaft mounting portion 42*a*. Consequently, the pickup roller 50 can be elongated/contracted. With this condition, the first convex portion 55*c* is fitted to the first concave portion 51*a* with the first convex portion 55*c* of the roller main body 55 aligned with the position of the first concave portion 51*a* in the drive shaft member 51. As a result, the pickup roller 50 having the new roller main body 55 is installed onto the printing mechanism unit 7.

Figure 2:
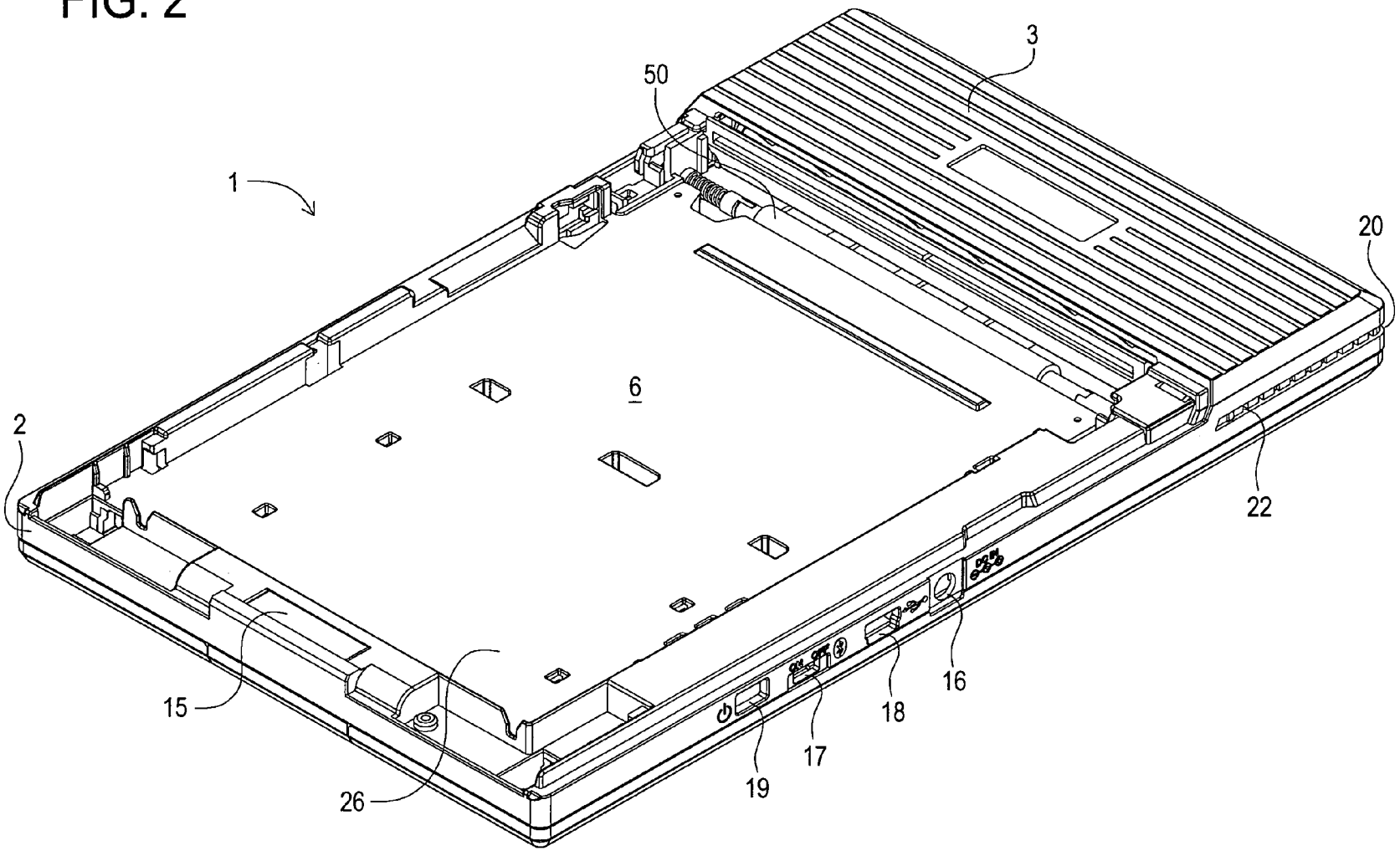
FIG. 2 is an explanatory diagram showing the vicinity of a paper accommodating portion in the portable small size printer unit.

As described above, the portable small size printer unit 1 of the first embodiment enables the replacement work of the pickup roller 50 by elongating/contracting the pickup roller 50 by sliding the slide shaft member 58 relative to the roller main body 55. Further, as shown in FIGS. 2, 3, the operation to the pickup roller 50 can be carried out directly from the paper accommodating portion 6 because the pickup roller 50 is exposed to the paper accommodating portion 6. That is, the replacement work of the pickup roller 50 can be carried out easily and rapidly without disassembly of the printing mechanism unit 7. Additionally, because no disassembly work of the printing mechanism unit 7 needs to be executed, no secondary fault occurs in the portable small size printer unit 1 after the replacement. The portable small size printer unit 1 of the first embodiment enables the replacement work of the pickup roller 50 to be carried out easily and rapidly even if any fault due to deterioration of the pickup roller 50 is generated, thereby consequently providing the portable small size printer unit 1 having a high availability.

The portable small size printer unit 1 of the first embodiment requires only the roller main body 55 to be replaced when the pickup roller 50 is replaced and as for the rotation restricting member 56, the spring 57 and the slide shaft member 58, the members already mounted before the replacement may be used again. Consequently, the cost for the members to be replaced can be reduced, thereby reducing burden on user and manufacturer accompanied by replacement of the pickup roller 50.

Second Embodiment

Next, an embodiment different from the first embodiment will be described as the second embodiment in detail with reference to the drawings. The second embodiment has the same basic structure as the portable small size printer unit 1 of the first embodiment. The same structure as the first embodiment of the second embodiment will be described with the same reference numerals. Because the second embodiment is different from the first embodiment in only the structure of the pickup roller, the pickup roller 60 of the second embodiment will be described in detail with reference to the drawings.

Figure 8:
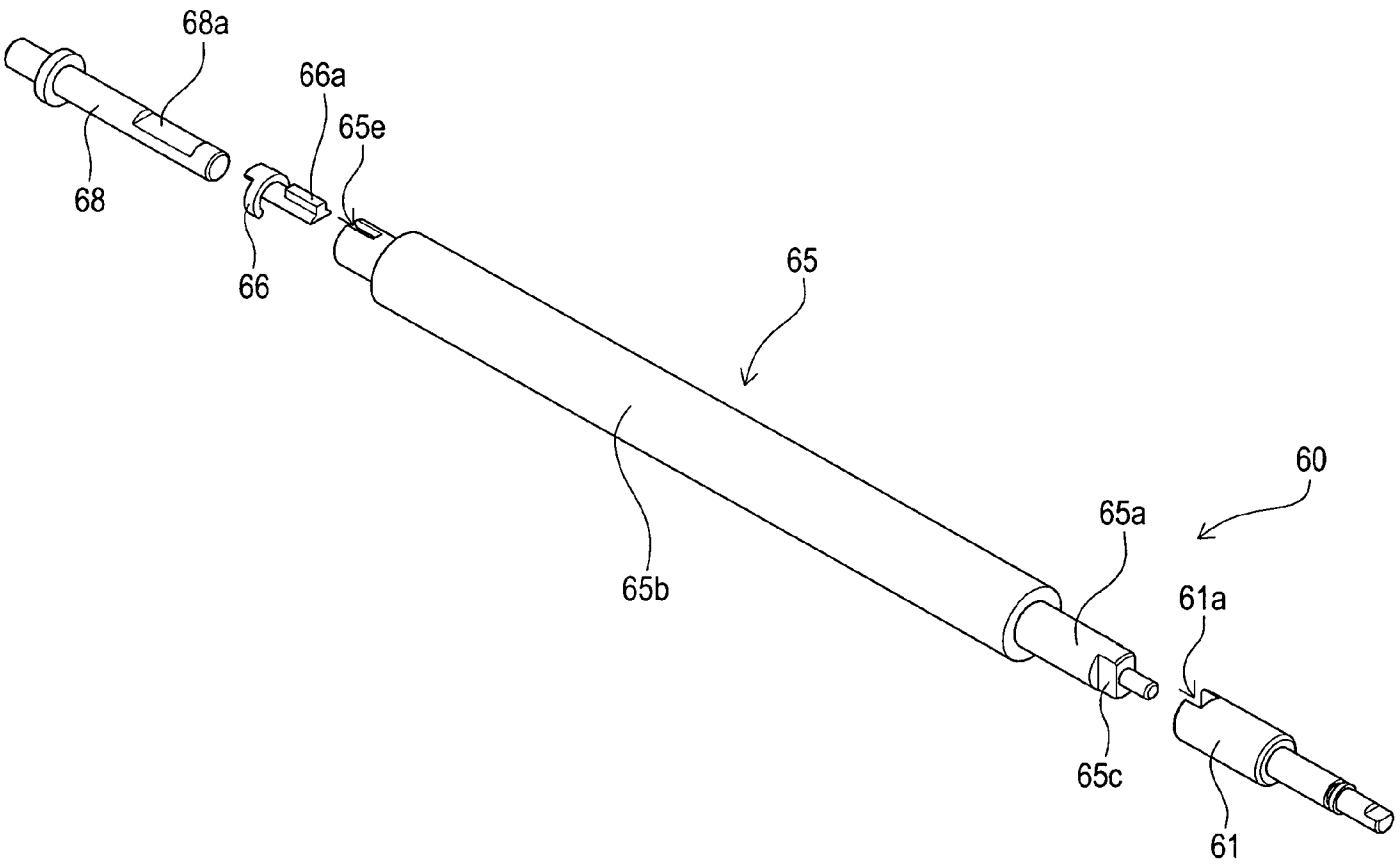
FIG. 8 is an explanatory diagram showing the structure of the pickup roller of a second embodiment.
Figure 9A:
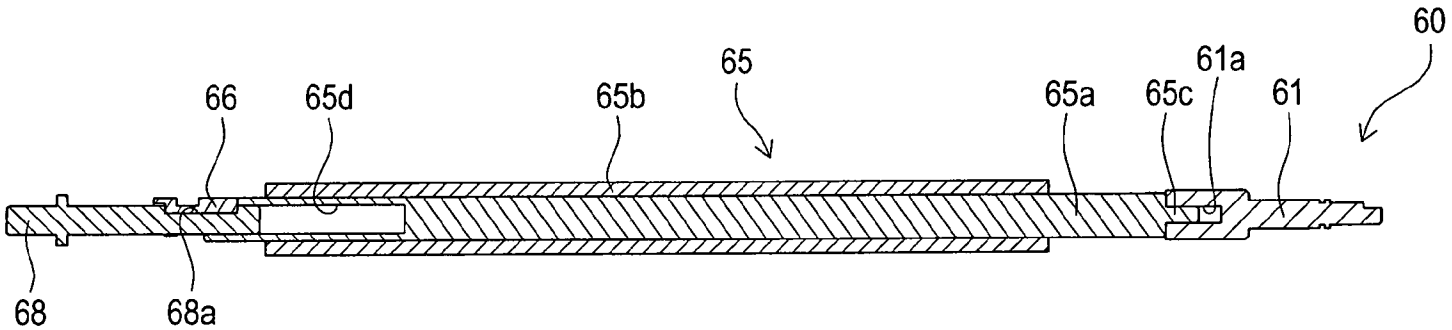
FIG. 9A is a sectional side view showing a condition in which the pickup roller of the second embodiment is mounted to the printing mechanism unit.
Figure 9B:
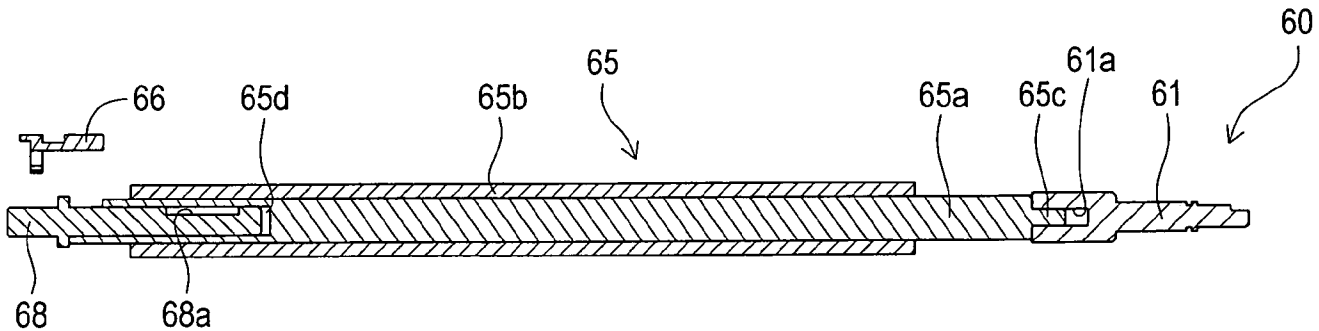
FIG. 9B is a sectional side view showing a condition in which the pickup roller of the second embodiment is slid.

As shown in FIG. 8, the pickup roller 60 of the second embodiment is comprised of a drive shaft member 61, a roller main body 65, a rotation restricting member 66, and a slide shaft member 68. The drive shaft member 61 is mounted on the roller drive gear 38 of the gear string 37 disposed on the outside face of the first side face 41 such that it penetrates the first side face of printing mechanism unit 7 like the drive shaft member 51 of the first embodiment. Thus, when the roller drive gear 38 constituting the gear string 37 is rotated by the driving of the driving motor 21, the drive shaft member 61 is rotated. In the meantime, this drive shaft member 61 cannot be removed from the first side face 41 because it is mounted on the roller drive gear 38 such that it penetrates the first side face 41. The drive shaft member 61 has a second concave portion 61*a* to which a second convex portion 65*c* formed at an end portion of the roller main body 65 is to be fitted (see FIGS. 8, 9). Because the second convex portion 65*c* is fitted to the second concave portion 61*a*, a rotation force generated in the drive shaft member 61 is transmitted to the roller main body 65 securely.

The roller main body 65 is comprised of a roller shaft member 65*a* formed cylindrically and coating rubber 65*b* disposed on the outer peripheral face of the roller shaft member 65*a* so as to come into contact with the paper 4. The second convex portion 65*c* to be fitted to the second concave portion 61*a* formed in the drive shaft member 61 is formed at an end of the roller shaft member 65*a* (see FIGS. 8, 9). The second convex portion 65*c* is so constructed that when it is fitted to the second concave portion 61*a*, it aligns the center axis of the drive shaft member 61 with the center axis of the roller main body 65 and a rotation force generated in the drive shaft member 61 is transmitted to the roller main body 65 securely. On the other hand, a sliding insertion hole 65*d* is formed at the other end of the roller shaft member 65*a* along the center axis of the roller shaft member 65*a* (see FIG. 9). A slide shaft member 68 is inserted slidably into this sliding insertion hole 65*d*. A cutout portion 65*e* is formed on an opening edge of the sliding insertion hole 65*d* by cutting out part of the opening edge. A restricting convex portion 66*a* of the rotation restricting member 66 described later is fitted into this cutout portion 65*e*.

An end side of the slide shaft member 68 is inserted slidably into the sliding insertion hole 65*d* in the roller main body 65 while the other end side thereof is fitted to the shaft mounting portion 42*a* in the second side face 42. As shown in FIG. 8, a sliding restricting portion 68*a* is formed in the vicinity of one end (side of the end portion which is to be inserted into the sliding insertion hole 65*d*) of the slide shaft member 68. This sliding restricting portion 68*a* is formed by cutting out part of the peripheral face of the slide shaft member 68 into a flat face and the position fixing member 66 described later is installed thereto (see FIGS. 9, 10).

The position fixing member 66 is a member which restricts the rotation of the slide shaft member 68 with respect to the roller main body 65 and restricts sliding of the slide shaft member 68. That is, the position fixing member 66 is a member which fixes a relative position of the slide shaft member 68 with respect to the roller main body 65. In the meantime, the position fixing member 66 is attached to the slide shaft member 68 detachably. The position fixing member 66 is provided to restrict itself from rotating with respect to the slide shaft member 68 through the sliding restricting portion 68*a* of the slide shaft member 68. The position fixing member 66 has a flat face which makes contact with the flat face formed in the sliding restricting portion 68*a* and the position fixing member 66 is blocked from rotating with respect to the slide shaft member 68 by cooperation of the both flat faces. The position fixing member 66 has a rotation restricting convex portion 66*a*. As described above, this rotation restricting convex portion 66*a* is fitted to the cutout portion 65*e* formed in the roller main body 65 (see FIGS. 9, 10). Thus, when the rotation restricting convex portion 66*a* is fitted to the cutout portion 65*e*, a rotation force generated in the roller main body 55 is transmitted to the position fixing member 66. Thus, like the first embodiment, the rotation force generated in the drive shaft member 61 is transmitted to the roller main body 65 and the slide shaft member 68 securely, so that the entire pickup roller 60 can be rotated accompanied by driving of the driving motor 21. Further, the position fixing member 66 is formed in the same length as the length in the axial direction of the sliding restricting portion 68*a* formed in the slide shaft member 68. Therefore, when the position fixing member 66 is mounted to the slide shaft member 68, the position in the axial direction of the slide shaft member 68 with respect to the roller main body 65 is fixed by cooperation of the position fixing member 66 and the sliding restricting portion 68*a* (see FIG. 9A). That is, when the position fixing member 66 is mounted to the slide shaft member 68, the entire length of the pickup roller 60 cannot be reduced.

To shorten the entire length of the pickup roller 60 from the normal condition (for example, a condition in which the pickup roller 60 is mounted (see FIG. 9A), the position fixing member 66 needs to be removed from the slide shaft member 68. By removing the position fixing member 66 from the slide shaft member 68, the slide shaft member 68 can be slid toward the center of the roller main body 65 (see FIG. 9B). That is, when the position fixing member 66 is removed from the slide shaft member 68, the entire length of the pickup roller 60 can be reduced.

Next, the procedure of the replacement work of the pickup roller 60 according to the second embodiment will be described in detail with reference to the drawings. FIGS. 10A-10E are explanatory diagrams showing the procedure for the replacement work of the pickup roller 60. When the coating rubber 65*b* of the pickup roller 60 is deteriorated, so that it needs to be replaced, the replacement worker removes the position fixing member 66 from the pickup roller 60 mounted to the printing mechanism unit 7 (see FIG. 10B). Because the position fixing member 66 is attached to the slide shaft member 68 detachably, the replacement worker can remove the position fixing member 66 easily. When the position fixing member 66 is removed, the slide shaft member 68 can be slid toward the center of the roller main body 65. Here, the replacement worker grips the slide shaft member 68 and moves it toward the center of the roller main body 65. Consequently, the entire length of the pickup roller 60 is shortened (see FIG. 10C) as compared with the normal condition (see FIG. 10A). By shortening the entire length of the pickup roller 60, the second convex portion 65*c* of the roller main body 65 can be removed from the second concave portion 61*a* in the drive shaft member 61.

Figure 10A:
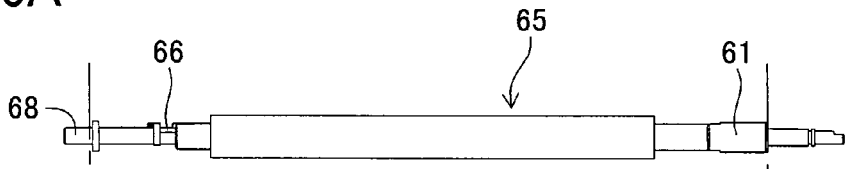
FIG. 10A is a diagram showing normal condition of the pickup roller of the second embodiment.
Figure 10B:
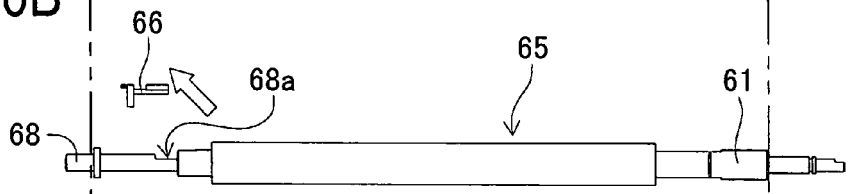
FIG. 10B is a diagram showing a condition in which a position fixing member is removed from the pickup roller of the second embodiment.
Figure 10C:
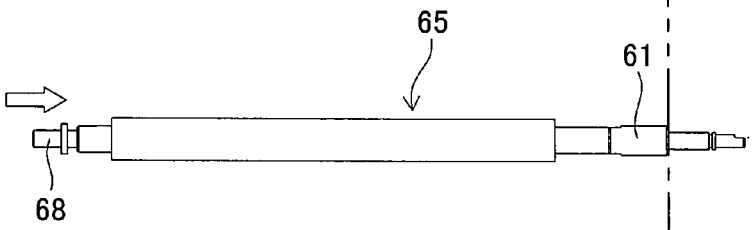
FIG. 10C is a diagram showing a condition in which the entire length of the pickup roller of the second embodiment is reduced as compared to the normal condition.
Figure 10D:
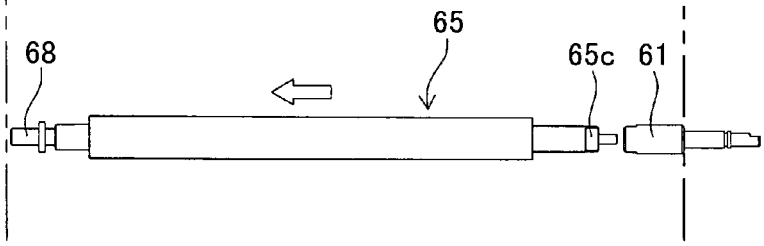
FIG. 10D is a diagram showing a condition in which the pickup roller of the second embodiment is removed from the printing mechanism unit.
Figure 10E:
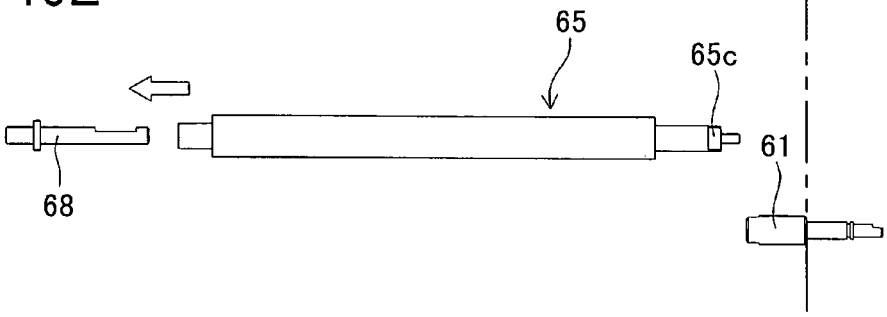
FIG. 10E is a diagram showing a condition in which the slide shaft member is removed from the main body of the pickup roller of the second embodiment.

After the entire length of the pickup roller 60 is shortened by sliding the slide shaft member 68, the replacement worker moves the pickup roller 60 in the axial direction and removes the second convex portion 65*c* of the roller main body 65 from the second concave portion 61*a* in the drive shaft member 61 (see FIG. 10D). After the second convex portion 65*c* is removed from the second concave portion 61*a*, the replacement worker removes the roller main body 65 from the printing mechanism unit 7 by tilting the roller main body 65. After the roller main body 65 is removed from the drive shaft member 61 and taken out of the portable small size printer unit 1, the replacement worker takes out the slide shaft member 68 from the roller main body 65 by sliding the slide shaft member 68 outward of the roller main body 65 (see FIG. 10E).

After the deteriorated roller main body 65 is replaced, the replacement worker attaches the slide shaft member 68 to the new roller main body 65. The second convex portion 65*c* is fitted to the second concave portion 61*a* with the second convex portion 65*c* of the roller main body 65 set to the second concave portion 61*a* of the drive shaft member 61. Consequently, an end of the pickup roller 60 is mounted to the printing mechanism unit 7. With this state, the slide shaft member 68 is slid outward of the roller main body 65 so as to fit the front end of the slide shaft member 68 to the shaft mounting portion 42*a*. Then, the other end of the pickup roller 60 is also mounted to the printing mechanism unit 7. To fix the position of the slide shaft member 68 with respect to the roller main body 65, the replacement worker attaches the position fixing member 66 to the sliding restricting portion 68*a* in the slide shaft member 68. At this time, the rotation restricting convex portion 66*a* of the position fixing member 66 is fitted to the cutout portion 65*e* of the roller main body 65. Consequently, the pickup roller 60 having the new roller main body 65 is mounted on the printing mechanism unit 7.

As described above, the portable small size printer unit 1 of the second embodiment enables the replacement work of the pickup roller 60 by elongating/contracting the pickup roller 60 by sliding the slide shaft member 68 relative to the roller main body 65 after the position fixing member 66 is removed. Further, as shown in FIGS. 2, 3, the operation to the pickup roller 60 can be carried out directly from the paper accommodating portion 6 because the pickup roller 60 is exposed to the paper accommodating portion 6. That is, the replacement work of the pickup roller 60 can be carried out easily and rapidly without disassembly of the printing mechanism unit 7. Additionally, because no disassembly work of the printing mechanism unit 7 needs to be executed, no secondary fault occurs in the portable small size printer unit 1 after the replacement. The portable small size printer unit 1 of the second embodiment enables the replacement work of the pickup roller 60 to be carried out easily and rapidly even if any fault due to deterioration of the pickup roller 60 is generated, thereby consequently providing the portable small size printer unit 1 having a high availability.

The portable small size printer unit 1 of the second embodiment requires only the roller main body 65 to be replaced when the pickup roller 60 is replaced and, as for the position fixing member 66 and the slide shaft member 68, the members already mounted before the replacement may be used again. Consequently, the cost for the members to be replaced can be reduced, thereby reducing burden on users and manufacturers accompanied by replacement of the pickup roller 60.

The present disclosure is not restricted to the above-described embodiments, but needles to say, may be improved or modified in various ways within a range not departing from the spirit of the present disclosure. For example, although the first and second embodiments have been described about cases in which the present disclosure is applied to portable small size printer units, the present disclosure is not restricted to these embodiments. That is, the printing object mediums in a stacked condition can be supplied by rotation of the supply roller.

While the presently exemplary embodiment has been shown and described, it is to be understood that this disclosure is for the purpose of illustration and that various changes and modification may be made without departing from the scope of the disclosure as set forth in the appended claims.

What is claimed is:

1. A printer unit comprising:

an accommodating portion which accommodates printing object mediums such that they are stacked;

a printing means for printing the printing object medium based on a desired print data;

a supply roller supported rotatably in contact with the printing object mediums accommodated in the accommodating portion; and supply means having a supply drive means for rotating the supply roller for supplying the printing object medium to the printing means, wherein the supply roller includes at least:

(A) a drive shaft member which is rotated with driving of the supply drive means;

(B) a roller member which is formed so that:

(a) the roller member has a contact portion on a peripheral face thereof so as to make contact with the printing object medium;

(b) one end of the roller member is attached detachably to the drive shaft member;

(c) a sliding hole is formed at the other end of the roller member along a center axis thereof; and (d) the roller member has a cutout portion formed so as to cut out a part of an opening edge of the sliding hole;

(C) a mounting shaft member, one end of which is inserted slidably into a sliding hole formed in the roller member so as to support the roller member rotatably, the mounting shaft member including a sliding restricting portion formed on a part of a peripheral surface thereof, the sliding restricting portion having a first flat face and first and second restricting ends in both sides of the first flat face, and a holding portion mounted at the other end thereof so as to protrude from a peripheral surface at the other end thereof;

(D) a rotation restricting member which is mounted on the sliding restricting portion of the mounting shaft member slidably in a shaft direction of the mounting shaft member so as to restrict a rotation of the roller member with respect to the mounting shaft member, the rotation restricting member having a sliding portion with a second flat face corresponding to the first flat face of the sliding restricting portion of the mounting shaft member, the sliding portion having a first end face and second end face; and (E) an elastic member which is disposed between the rotation restricting member mounted on the sliding restriction portion of the mounting shaft member and the holding portion formed on the mounting shaft member in such a manner that the mounting shaft member is inserted in the elastic member so as to bias the mounting shaft in a direction of elongating the supply roller, wherein the rotation restricting member has a restricting convex portion which corresponds to the shape of the cutout portion and is to be fitted to the cutout portion, and wherein the mounting shaft member is rotated together with the roller member by the rotation restricting member, wherein the rotation restricting member is mounted on the sliding restricting portion of the mounting shaft member so that the first flat face of the sliding restricting portion in the mounting shaft member and the second flat face of the sliding portion in the rotation restricting member slidably contact with each other, and wherein when the mounting shaft member is discharged from the sliding hole of the roller member, the first end face of the sliding portion in the rotation restricting member contacts with the first restricting end of the sliding restricting portion in the mounting shaft member by elastic force of the elastic member disposed between the holding portion of the mounting shaft member and the second end face of the sliding portion in the rotation restricting member.

2. The printer unit according to claim 1, wherein the drive shaft member has a first concave portion formed in a predetermined shape at an end portion of the drive shaft member, the roller member has a first convex portion formed in a shape corresponding to the shape of the first concave portion at an end portion of the roller member, and the roller member is capable of being attached detachably to the drive shaft member by fitting the first convex portion to the first concave portion in the drive shaft member.

* * * * *